US007044059B2

(12) United States Patent
Koch et al.

(10) Patent No.: US 7,044,059 B2
(45) Date of Patent: May 16, 2006

(54) METHOD AND DEVICE FOR COOLING PRINTING STOCK AND PRINTING PRESSES

(76) Inventors: Michael Koch, Weinbergstr. 76, DE 01462 Cossebaude (DE); Tilo Steinborn, Questerberger Weg 28, DE 01682 Meissen (DE)

( * ) Notice: Subject to any disclaimer, the term of this patent is extended or adjusted under 35 U.S.C. 154(b) by 105 days.

(21) Appl. No.: 10/899,333

(22) Filed: Jul. 26, 2004

(65) Prior Publication Data

US 2005/0115432 A1 Jun. 2, 2005

(30) Foreign Application Priority Data

Jul. 30, 2003 (DE) ..... 103 34 657

(51) Int. Cl.
*B41F 23/04* (2006.01)
*B41F 13/22* (2006.01)

(52) U.S. Cl. ..... 101/487; 101/232; 101/216

(58) Field of Classification Search ..... 101/487, 101/488, 212, 216, 416.1, 419, 232, 424.1

See application file for complete search history.

(56) References Cited

U.S. PATENT DOCUMENTS

| | | | | |
|---|---|---|---|---|
| 5,178,064 | A | 1/1993 | Kerber et al. | |
| 5,452,657 | A | 9/1995 | Kurz | |
| 5,588,360 | A | 12/1996 | Kurz | |
| 5,979,325 | A | 11/1999 | Mitze et al. | |
| 6,416,051 | B1 | 7/2002 | Autz | |
| 6,571,711 | B1 | 6/2003 | Bostrack | |
| 6,983,696 | B1 * | 1/2006 | Koch et al. | 101/487 |
| 2003/0121440 | A1 | 7/2003 | Koch et al. | |

FOREIGN PATENT DOCUMENTS

| | | |
|---|---|---|
| DE | 101 58 051 A1 | 6/2003 |
| EP | 1 314 557 A1 | 5/2003 |

* cited by examiner

*Primary Examiner*—Leslie J. Evanisko

(57) ABSTRACT

A device for cooling printing stock and printing units by refrigerated air blast at sheet-fed rotary printing presses.

It is an object of the invention to provide a method and a device, which require little energy and space and, at the same time, ensure that the printing stock and the printing press are protected against harmful effects of temperature.

Pursuant to the invention, this objective is accomplished owing to the fact that the refrigerated air blast, after contact with the surface of a sheet-guiding cylinder (2) of at least one pneumatic sheet-guiding device (12, 13, 14; 15, 16; 17, 18, 19), is recycled at least partially.

20 Claims, 2 Drawing Sheets

METHOD AND DEVICE FOR COOLING PRINTING STOCK AND PRINTING PRESSES

FIELD OF THE INVENTION

The invention relates to a method and a device for cooling printing stock and printing presses by means of refrigerated air blasting on sheet-fed rotary printing presses with at least one pneumatic sheet-guiding device.

BACKGROUND OF THE INVENTION

It is generally known that dryers may be disposed at or between printing units as well as in the delivery area in order to support the drying and curing processes of printing inks and lacquers. This causes transfer of large amounts of heat from the UV or infrared dryers to the printing stock and the parts of the printing press adjacent to the dryers. Furthermore, printing with constant high speeds and with highly viscous (nonaqueous) printing inks further heats the cylinders guiding the printing ink and the sheets. The amount of heat transferred to the printing stock and printing press due to friction, convection or radiation is a significant interfering parameter in the printing process, because it changes the viscosity of the printing ink so that the ink control is affected and there is a greater danger that sheets will adhere or that thermally sensitive printing stock, such as plastic sheets, will become damaged or deformed. Moreover, this heat also affects the mode of functioning of adjoining machine elements, if these are heated above the permissible level.

Additional cooling devices are known, the purpose of which is to prevent overheating of printing press elements in the region of the dryer. To cool sheet-guiding surfaces in the region of action of dryers, channels for cooling agents are disposed on the underside of dryers (for example, DE 19810387 C1) However, the cooling effect is limited to the baffle plate but the adjoining cylinder groups and printing stock are not cooled.

The use of a refrigerated air blast for cooling cylinders is known, for example, from DE 4326835 A1 and DE 4307732 A1, which show additional air blast cooling beams with cycled cooling air for cooling rubber and/or plate cylinders limited to the blowing device. The portion of the cooling air, flowing back from the cylinders surface, is exhausted once again at the air blast cooling beam, cooled again and then, once more, blown onto the upper surface of the cylinders. Moreover, DE 43 07 732 A1 discloses a temperature-controlling system for three adjacent cylinders, which has an outer air-circulation cycle, for which leakage air of the air blast cooling beams is returned to the cooling device from the closed airspace formed by the adjacent cylinders, the air blast cooling beams and additional boundary surfaces.

Furthermore, WO 01/32423 A1 discloses the cooling of printing stock heated by dryers, as well as indirect cooling of printing cylinders and transfer cylinders by air blast cooling devices, which have cooling registers and ventilating fans and are additionally disposed before the printing zone. This air blast cools the printing cylinders on the sheet-guiding casing section. As a result, there is intensive cooling of the printing stock. However, because of the insulating effect of the sheet on the cylinder, cooling of the cylinder is not satisfactory. Furthermore, the relationship between the intensity of the cylinder cooling and the nature of the printing stock is a disadvantage.

For cooling sheet-shaped printing stock, especially sheets, which are in danger of being distorted, additional cooling air-blowing facilities are provided below the transfer cylinders and/or ahead of the printing zone according to DE 10158050 A1 and DE 10158051 A1. Such facilities can be integrated partly into existing sheet-guiding facilities.

The object of DE 101 52 593 A1 overcomes the disadvantage of the need for additional space for the cooling devices by arranging cooling registers in the air stream of existing air blast sheet guiding devices below the transfer cylinders, in front of printing columns and above transfer regions in the UV dryer area.

All of the cooling systems mentioned above have the common disadvantage that they are designed only for special cooling tasks, that is, either only for cooling printing stock or only for cooling cylinders and have only strictly limited areas of effectiveness. However, especially when printing temperature-sensitive plastic sheets, it is important to cool not only the printing stock intensively but also the machine elements guiding the printing stock.

SUMMARY OF THE INVENTION

It is therefore an object of the invention to provide a method and a device for cooling printing stock and printing presses without the disadvantages mentioned above and provide a cooling system for printing stock and printing presses which requires little energy and space and, at the same time, ensures protection of the printing stock and the printing press against the harmful effects of temperature.

The present invention allows simultaneous cooling of sheet-guiding cylinders and printing stock with a stream of cooling air, which is refrigerated initially in an air blast cooling device, then sweeps over the surface of a sheet-guiding cylinder and subsequently is used for guiding the printing stock with an involvement of the existing pneumatic sheet-guiding devices and, at the same time, cools the printing stock. Because of the open guidance of the cooling air, a portion of the cooling air, instead of reaching the sheet-guiding devices, flows into the printing unit and thus, cools additional elements of the printing press. In this way, the cooling capacity of the refrigerated air blast is used repeatedly.

In comparison to the arrangement of several air blast cooling devices acting independently of one another, there are clear advantages with respect to the cooling capacity provided and the heat-exchange area which can be used to cool the printing stock and the cylinders. In the relatively defined air space below the printing and lacquer cylinders, a refrigerated air storage space is created, from which the devices for cooling the cylinders and printing stock take air that has already been precooled. At the same time, the printing and lacquer cylinders are cooled in a particularly effective manner, since in this region there is no insulating sheet on the cylinder casing.

In addition, the cooling air paths, which connect the cooling system, are short and extend in the immediate vicinity of the surfaces of the cylinders and of the sheet-transporting path, so that the cooling potential of the cooling air is not limited by the undesirable absorption of heat from areas which do not participate directly in guiding the sheets.

Furthermore, as a result of the conveying effect of the revolving grabbing bridges of the transfer cylinders, which are comparable with paddle wheels, the cooling air emerging from the compressed air boxes for guiding sheets is carried along up to the comb suction box at the downstream printing cylinder, so that a constant current of cooling air is maintained, starting out from the first cooled printing unit and continuing in the sheet-transporting direction up to the subsequent printing units. This current of cooling air constantly keeps the printing stock cooled while it is being transported between printing units and thus, the cooling capacity required from the second printing unit onward can be reduced.

Accordingly, with the inventive coupling of the air blast cooling and sheet-guiding devices, the printing stock as well as the printing press cylinders can be cooled along the path of the sheet with a minimum consumption of cooling air.

In view of the basic objective, the cooling-air coupling and the efficiency of the individual cooling devices can be increased by additional sealing effects provided by the cooling air-guiding elements along the flow path of the cooling air.

BRIEF DESCRIPTION OF THE DRAWINGS

The inventive embodiments below are to be explained by means of the drawings of a section of a sheet-fed offset printing press in side view. In the drawings.

DETAILED DESCRIPTION OF THE INVENTION

Figure 1:
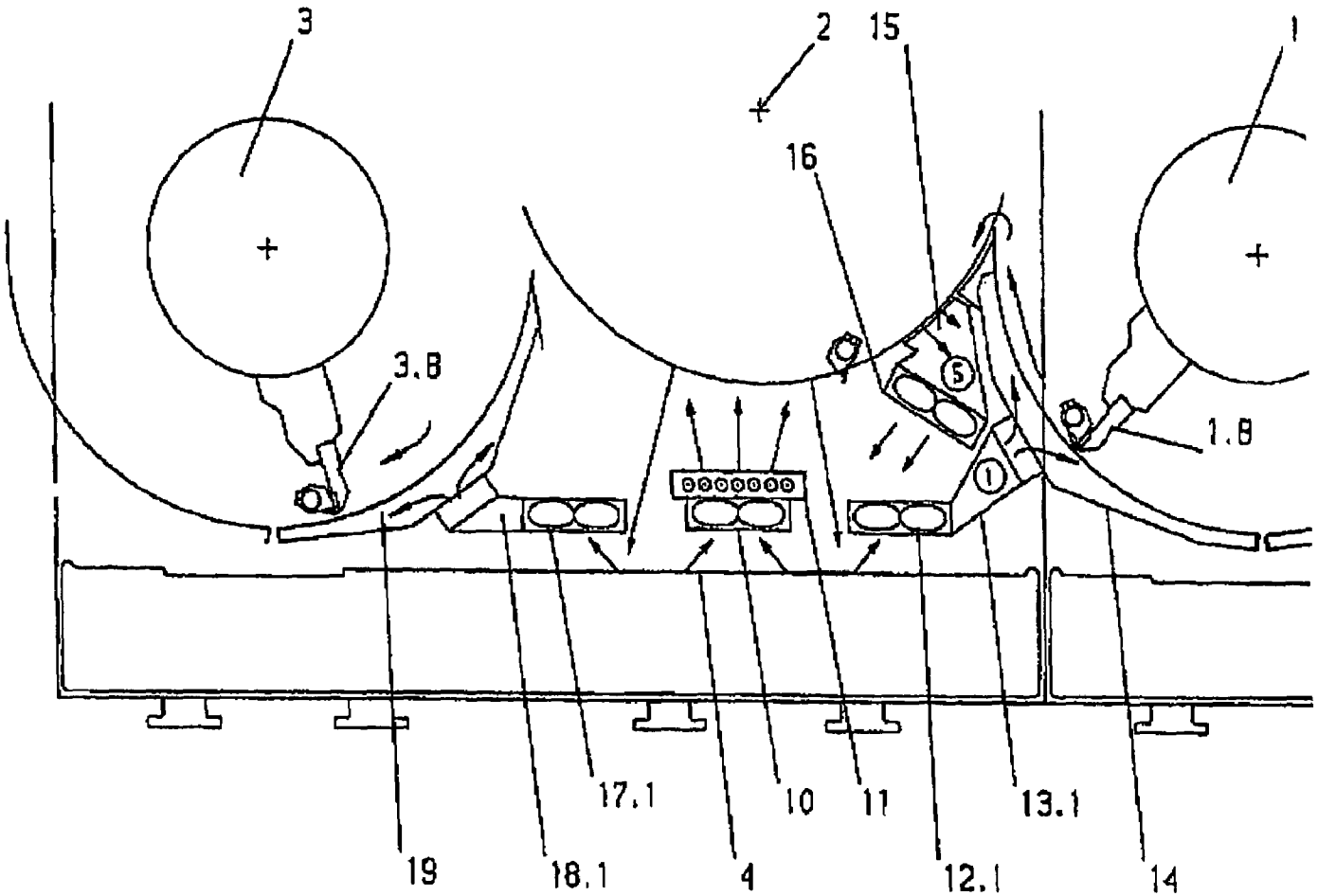
FIG. 1 shows a first variation of the cooling of the printing stock and the printing press and FIG. 2 shows a second variation of the cooling of the printing stock and printing press with increased coupling of cooling air.

FIG. 1 shows a diagrammatic representation of a printing and lacquering cylinder 2 of a printing and lacquering unit of a sheet-fed rotary printing press of a series construction with upstream and downstream transfer cylinders 1, 3 and the floor assembly of a machine frame 4. Known pneumatic sheet-guiding devices are disposed along the path of the sheets. Two air-cushion guides 12.1, 13.1, 14 and 17.1, 18.1, 19 are shown under the transfer cylinders 1, 3 and a comb suction box 15, 16 is shown in the transfer region of the transfer cylinder and the printing cylinder 1, 2. Both are shown by way of example.

Two known compressed air boxes 14 and 19 disposed beneath the transfer cylinders 1, 3 make a contactless transport of the sheet possible, because the sheets are guided on an air cushion. In particular, when plastic sheets are printed, scratching of the surface of the sheets at the guiding devices can be prevented in this way. A boundary layer of air carried along by the surface of the printing cylinder casing and the supporting air cushion under the sheet are drawn off ahead of the printing zone by the comb suction box 15, 16, so that the sheet can lie smoothly on the printing cylinder 2.

In accordance with the proposed solution, one or more additional blowing devices 10 are disposed under one or more of the printing cylinders 2 to be cooled, and each directs an upward stream of cooling air onto the surface of the printing cylinder. This place is particularly advantageous for air blast cooling of the printing cylinder 2, since the current of air strikes the cylinder surface directly at this place and thus, produces its cooling effect completely.

The blowing device 10 may, for example, be a row of ventilating fans disposed next to and parallel to one another in a row and in the air blast of which there are one or more air blast cooling devices 11. The cooling devices 11 are constructed as well-known cooling surface arrangements (cooling registers), through which a coolant is flowing. The cooling devices 11 may also be disposed equally well on the suction side of the ventilating fans.

Instead of having the blowing device 10 underneath the printing cylinder 2, the cooling air may also be blown in sideways (not shown) by a blowing device at the machine frame or by a blowing device 10 outside of the printing press under the printing cylinder 2 with the help of a cooling air strut or the like if, for example, the available space is inadequate for a blowing device 10. Due to the arrangement of an exhaust channel beneath the printing cylinder 2 or on the opposite side of the printing press, the flow of cooling air for this embodiment back to the air blast cooling device 11, which may also be either at the machine frame or outside of the printing press, must be secured. However, the advantage of having cooling air paths in the vicinity of the cylinders or the printing stock may be partially lost.

For the first variation of the cooling device proposed in this application, radial ventilation fans 12.1, 17.1 are used for supplying an air blast to the compressed air boxes 14, 19, which take hold of the subsided cold air with the downwardly directed intake side. The radial ventilating fans 12.1, 17.1 are connected over air ducts 13.1, 18.1 with the compressed air boxes 14, 19.

The method, which may be realized with the device proposed, proceeds as follows. The air blast is refrigerated to me cooling temperature in the air blast cooling device 11 and blown by the blowing device 10 from below against the casing surface of the printing cylinder 2. Accordingly, it initially cools the printing cylinder 2 and is diverted there and discharged into the lower air space region at the machine frame 4. The cooling air is partly exhausted by the neighboring radial ventilating fans 12.1, 17.1 from the lower air space over the air ducts 13.1, 18.1 to the air boxes 14, 19 and along the path of the sheet between the printing units, forms cooling air cushions, which cool the printing stock sheet. When the sheet is transferred by the transfer cylinder 1 to the printing cylinder 2, the supporting cooling air cushion below the sheet is exhausted by the comb suction box 15, 16 and blown into the lower cooling air space beneath printing cylinder 2. At the same time, the comb suction box 15, 16 also reduces the interfacial flow at the printing cylinder 2 and thus, presents a barrier of cooling air, which prevents the cooling air flowing away in the transfer region 1, 2. The cooling air, which is heated by the printing cylinder 2 and printing stock and recycled, is exhausted again by the blowing device 10 and recooled. It then flows again in the direction of the printing cylinder 2 and, after striking the cylinder surface and flowing away into the intake zones of the pneumatic sheet-guiding devices 12.1, 13.1, 14 and 17.1, 18.1, 19, is directed into the path of the sheets, where the printing stock is cooled and, at the same time, guided.

The portions of cooling air which flow away from the cooled cylinders and do not reach the sheet-guiding devices are dissipated in the printing unit, mixed with warmer air and cool further printing press elements along their path of flow. In this way, the cooling capacity of the refrigerated air blast is utilized repeatedly.

The cooling air of the air cushions is carried along by the conveying action of the gripper strips 1.B, 3.B and reaches the area of action of the next cooling device at the subsequent printing unit Thus, a continuous stream of cooling air is formed along the sheet-transporting path between the printing units and cools the printing stock intensively and enables the cooling capacity required from the second, cooled printing unit onward to be reduced in comparison to that of the first cooled printing unit.

This first variation of an embodiment of FIG. 1 is optimal for retrofitting printing units with air blast cooling, because tile series equipment is not changed, with the exception of the ventilating fans 12.1, 17.1, which are exchanged, and the additional blowing and cooling device 10, 11. Further installations are not needed and the control system has no additional requirements because of the open manner in which the air blast is guided.

Since the cooling air connection between the individual ventilating fans 10, 12.2, 16, 17.2 is relatively open, there are advantageously wide tolerances for controlling the individual cooling sections. Moreover, a relatively high proportion of cooling air can escape from the air space beneath the printing cylinders, so that the printing unit regions above are also cooled effectively and the whole printing press may be cooled with the proposed cooling air system.

Figure 2:
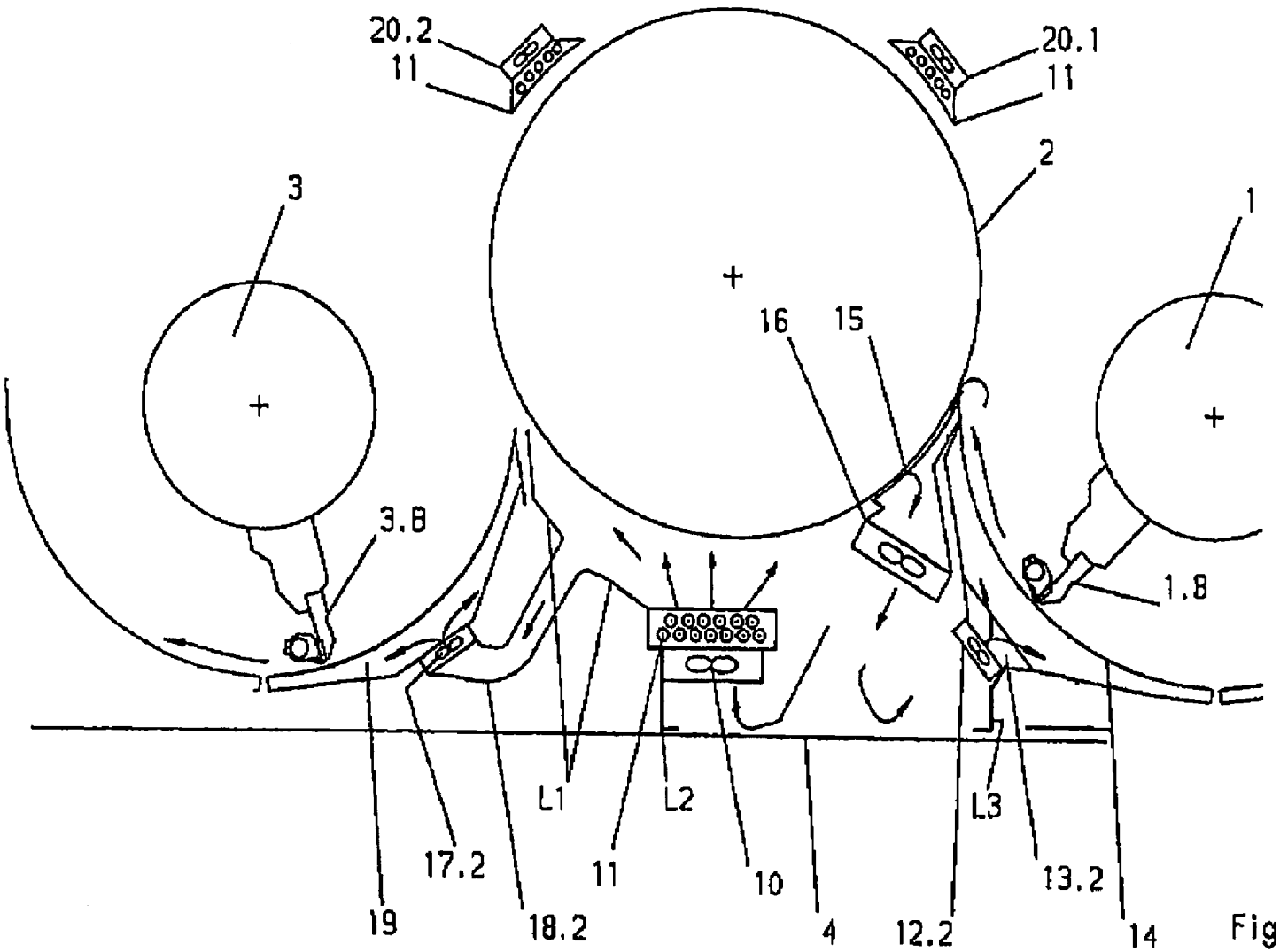

In the event that the cooling action is to be concentrated on the sheet-guiding region, the coupling of the cooling air between the ventilating fans 10, 12.2, 16, 17.2 can be enhanced by additional air-guiding measures as shown in FIG. 2.

For this second variation, the flow of cooling air from the air space below the printing cylinder 2 is reduced by additional cooling air guiding elements L1, L2, L3, which are parallel to an axis and form an axial boundary for the cooling space. The guiding elements L1 guide the cooling air conveyed by the blowing device 10 along the casing surface of the printing cylinder 2 counter to its direction of rotation. In the vicinity of the transfer region between the printing cylinder 2 and the subsequent transfer cylinder 3, axial ventilating fans 17.2 exhaust the cooling air from the surface of the printing cylinder and thus, produce an air cushion for guiding The sheets by means of compressed air boxes 19. In the direction of rotation of the printing cylinder 2, the downward guidance of the cooling air at the printing cylinder 2 is not limited by baffles, because the cooling air is returned in this region to the intake side of the blowing device 10. The cooling air space to the upstream transfer cylinder 1 is adequately bounded by the comb suction box 15, 16, which exhaust the cooling air from the transfer region between the upstream transfer cylinder 1 and the printing cylinder 2, and the compressed air box 14. At the same time, the comb suction box 15, 16 supports the flow of cooling air back into the intake zone of the blowing device 10, which is bounded additionally by guiding elements L2, L3 for the second variation, in order to prevent the flow of cooling air from the cooling air storage space below the printing cylinder 2. In addition to the blowing device 10, the ventilating fan 12.2 conveys the cooling air flowing back from the printing cylinder 2, from an area close to the floor and creates a further cycle of cooling air over the air channel 13.2 to the compressed air box 14 and over the comb suction box 15, 16 back into the cooling air intake zone of the blowing device 10.

The second variation of the inventive cooling device can also be realized with conventional axial ventilating fans 12.2, 17.2.

Since the air is refrigerated only in the single cooling device 11, it may be advantageous for a better control of the individual cooling air cycles (10-11-15-16, 12.2-13.2-14-15-16, 10-11-L1-18.2-17.2-19-15-16) if the parts of the central cooling device 11 are assigned to each individual cycle as separate cooling devices 11, which refrigerate pre-cooled air streams as required and independently of one another. Cooling devices 11 for this purpose may be disposed on the intake side of the ventilating fans 12.2 and 17.2 or also in the air-guiding ducts 13.2 and 18.2. The individual parts of the cooling device 11 advantageously are coupled with the cooling device 11 over a common coolant cycle and control means.

Furthermore, the flexible conception of the cooling system makes it possible to combine the system with additional known pneumatic sheet-guiding devices 20.1, 20.2 which have cooling devices 11 in the path of the sheets, which cannot be cooled by the inventive cooling device, on the printing cylinder 2 before and after the printing zone. These pneumatic sheet-guiding devices 20.1, 20.2 may be constituted as described, for example, in DE 101 52 593 A1. By means of such an air arrangement, an intensive cooling, especially of sensitive printing stock (films) becomes possible over the whole path, along which the sheets are transported through the printing press.

The invention claimed is:

1. A method for cooling printing stock and a printing press, said printing press comprising at least one pneumatic sheet-guiding device and a printing cylinder, said method comprising:

blasting refrigerated air onto said printing press whereby a refrigerated air blast contacts a surface of said printing cylinder; and supplying said refrigerated air blast at least partially after contacting said surface of said printing cylinder to said at least one pneumatic sheet-guiding device.

2. The method of claim 1, wherein said supplying step comprises supplying said refrigerated air blast at least partially after contacting said surface of said printing cylinder to an intake zone of said at least one pneumatic sheet-guiding device disposed at a sheet-guiding cylinder upstream or downstream from said printing cylinder.

3. The method of claim 2, wherein said refrigerated air blast is directed to a section of said surface of said printing cylinder which does not guide sheets.

4. The method of claim 1, wherein a portion of said refrigerated air blast cools additional elements of said printing press which do not guide sheets.

5. A device for cooling printing stock and a printing press, by means of a refrigerated air blast, said printing press comprising a printing cylinder and at least one pneumatic sheet-guiding device, said at least one pneumatic sheet-guiding device comprising an intake zone, said device comprises:

at least one air blast cooling device for supplying said refrigerated air blast; and at least one blowing device;

wherein said at least one air blast cooling device is assigned to said at least one blowing devices;

wherein said refrigerated air blast is directed to a surface of said printing cylinder, and wherein said intake zone of said at least one pneumatic sheet-guiding device is disposed in a flow path of said refrigerated air blast flowing back from said surface of said printing cylinder.

6. The device of claim 5, wherein said refrigerated air blast is directed from said at least one blowing device to a section of said surface of said printing cylinder which does not guide sheets, and said at least one pneumatic sheet-guiding device is disposed at a sheet-guiding cylinder upstream or downstream from side printing cylinder.

7. The device of claim 6, wherein said at least one pneumatic sheet-guiding device is constructed as an air cushion guiding device.

8. The device of claim 6, further comprising additional refrigerated air guiding elements forming a boundary of a cooling air space parallel to an axis between said at least one blowing device and said intake zone of said at least one pneumatic sheet-guiding device, so that the coupling of refrigerated air is enhanced.

9. The device of claim 6, wherein an air blast cooling device is also assigned to said at least one pneumatic sheet-guiding device.

10. The device of claim 5, wherein said at least one pneumatic sheet-guiding device is constructed as an air cushion guiding device.

11. The device of claim 10, further comprising additional refrigerated air guiding elements forming a boundary of a cooling air space parallel to an axis between said at least one blowing device and said intake zone of said at least one pneumatic sheet-guiding device, so that the coupling of refrigerated air is enhanced.

12. The device of claim 10, wherein an air blast cooling device is also assigned to said at least one pneumatic sheet-guiding device.

13. The device of claim 5, wherein said at least one blowing device and said at least one air blast cooling device are disposed parallel to an axis beneath said printing cylinder.

14. The device of claim 13, further comprising additional refrigerated air guiding elements forming a boundary of a cooling air space parallel to an axis between said at least one blowing device and said intake zone of said at least one pneumatic sheet-guiding device, so that the coupling of refrigerated air is enhanced.

15. The device of claim 5, wherein said at least one blowing device and said at least one air blast cooling device blow a stream of refrigerated air sideways into an air space beneath said printing cylinder.

16. The device of claim 15, wherein an intake zone of said at least one blowing device is disposed beneath said printing cylinder or on the side of the printing press opposite to the side at which air is blown in.

17. The device of claim 5, further comprising additional refrigerated air guiding elements forming a boundary of a cooling air space parallel to an axis between said at least one blowing device and said intake zone of said at least one pneumatic sheet-guiding device, so that the coupling of refrigerated air is enhanced.

18. The device of claim 5, wherein an air blast cooling device is also assigned to said at least one pneumatic sheet-guiding device.

19. The device of claim 5, wherein said at least one air blast cooling device is formed by cooling surfaces, through which a coolant is flowing, in a suction stream or an air blast of said at least one blowing device or of said at least one pneumatic sheet-guiding device or at air blast guiding elements.

20. The device of claim 5, further comprising one or more additional pneumatic sheet-guiding devices and one or more additional air blast cooling devices assigned to said one or more additional pneumatic sheet-guiding devices before and/or after a printing zone.

* * * * *